US006582104B2

(12) United States Patent
Miller et al.

(10) Patent No.: US 6,582,104 B2
(45) Date of Patent: Jun. 24, 2003

(54) DECORATIVE LIGHTING FIXTURES

(76) Inventors: Jack V. Miller, 20961 Sussex Hwy. 13, Seaford, DE (US) 19973; Ruth E. Miller, 20961 Sussex Hwy. 13, Seaford, DE (US) 19973

( * ) Notice: Subject to any disclaimer, the term of this patent is extended or adjusted under 35 U.S.C. 154(b) by 28 days.

(21) Appl. No.: 09/920,113

(22) Filed: Aug. 2, 2001

(65) Prior Publication Data

US 2003/0035293 A1 Feb. 20, 2003

(51) Int. Cl.[7] ..... F21V 11/00
(52) U.S. Cl. ..... 362/356; 362/280; 362/319
(58) Field of Search ..... 362/404, 351, 362/147, 356, 359, 361, 319, 277, 280

(56) References Cited

U.S. PATENT DOCUMENTS 4,763,231 A * 8/1988 Houplain ..... 362/148
6,244,733 B1 * 6/2001 Fong et al. ..... 362/147

* cited by examiner

*Primary Examiner*—Sandra O'Shea
*Assistant Examiner*—John Anthony Ward

(57) ABSTRACT

A lighting fixture has a proximal end fixture adapter connectable at a proximal end to a mounting device attachable to a ceiling. The mounting device may be an elongated track, a fixed canopy or a ceiling ring permitting a proximal portion of the fixture to be above the ceiling. The lighting fixture has a generally cylindrical housing with first and second resilient rings partially engaged into first and second external grooves around the distal end of the housing. A decorative shade has a fitter slidable on the housing and retained between the first and second resilient rings.

5 Claims, 3 Drawing Sheets

DECORATIVE LIGHTING FIXTURES

BACKGROUND—FIELD OF THE INVENTION

This invention relates to the field of lighting, and particularly to tracklight and downlight fixtures that are normally ceiling mounted.

BACKGROUND—DESCRIPTION OF PRIOR ART

Prior art tracklight and downlight fixtures that depend from a ceiling are typically bare reflector lamps or cylindrical metal cans painted black or white. The result is a purely functional lighting, usually creating an ugly, cluttered ceiling, without aesthetic values. Some residential fixtures decorative glass shades that have a groove, engaged by three equally-spaced radial thumb-screws in a fitter that keeps the shade from falling off the fixture. The shade holders and fitters are bulky and ill-fitting to the point where they are often tilted out of square; and if the screws are over-tightened, delicate glass shades may break under differential thermal expansion between the fixture and the shade.

OBJECTS OF THE INVENTION

The principal object of the present invention is to provide a lighting fixtures with decorative aesthetics that may be selected by a user from a variety of styles, including personalized custom designs. Another object of the invention is to provide a decorative shade attachment to a tracklight or downlight fixture that is simple, easy to install and remove and is inexpensive to manufacture.

SUMMARY OF THE INVENTION

The objects of the present invention is achieved by a simple, reliable and inexpensive method for attaching decorative shades of any material to generally cylindrical lighting fixtures, in which the fixture housing has an external ring groove above and below a shade fitter. The shade fitter is then axially held in place between a pair of external, resilient rings in the ring grooves. In a preferred embodiment the resilient rings are made of a clear, heat resistant plastic material that shows the underlying colors of the light fixture and shade.

ADVANTAGES OF THE INVENTION

The present invention achieves the object of the invention by providing decorative shades that may be selected from an inventory or custom made for a customer, such as a restaurant, hotel or retail chain. Another advantage is that similar decorative elements may be added to tracks according to the applicants' co-pending application entitled DECORATIVE LIGHTING TRACK, whereby light fixtures and lighting tracks can have a matched decorative theme. The structure of the invention, in which a shade fitter is axially held on a fixture housing between external resilient rings in ring grooves is simple, inexpensive and nearly invisible, and the resilient rings do not apply thermal stresses to even the most fragile decorative shades.

REFERENCE NUMERALS IN DRAWINGS

| | | | |
|---|---|---|---|
| 1 | prior art track system | 2. | prior-art track |
| 3 | depending tracklight fixtures | 4 | ceiling |
| 5 | shade holder | 6 | thumb screws |
| 7 | prior-art shade fitter | 8 | glass tulip shade |
| 9 | glass bullet shade | 10 | glass bowl shade |
| 11 | glass square shade | 12 | present invention tracklight |
| 13 | present invention shade | 14 | fixture adapter |
| 15 | cylindrical fixture housing | 16 | first ring groove |
| 17 | second ring groove | 18 | first retaining ring |
| 19 | second retaining ring | 20 | shade fitter |
| 21 | decorative shade pattern | 22 | co-pending application track |
| 23 | decorative track pattern | 24 | aimable downlight |
| 25 | canopy | 26 | fixed downlight |
| 27 | ceiling mounting ring | | |

DETAILED DESCRIPTION OF THE DRAWINGS

Figure 1:
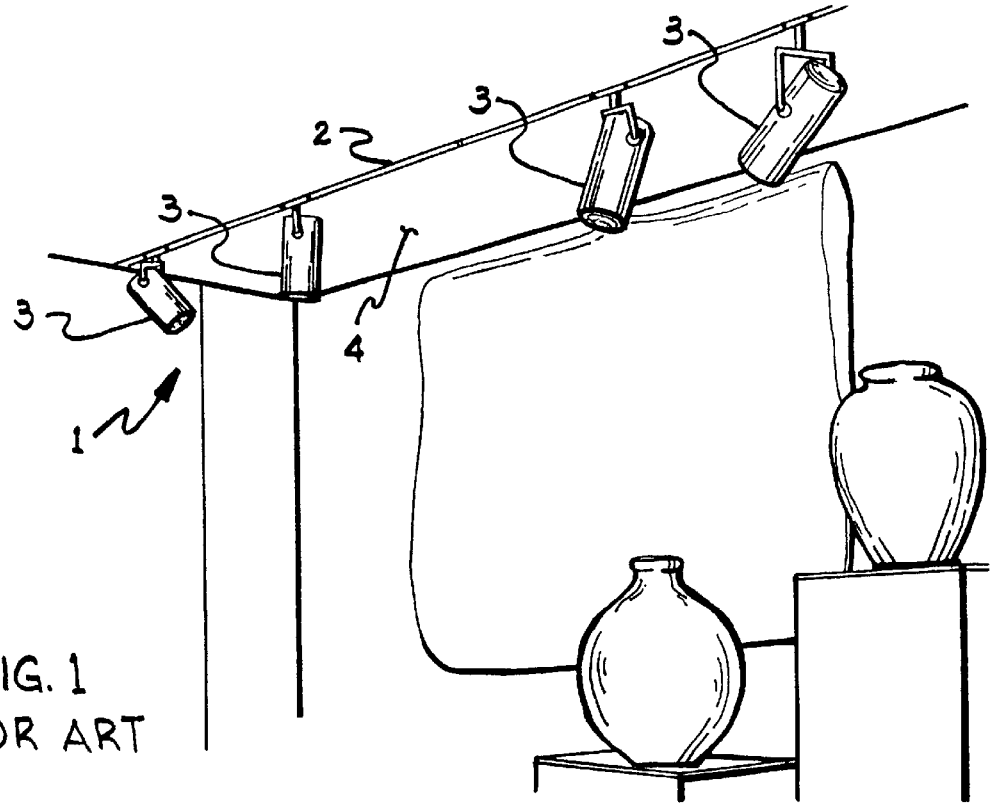
FIG. 1 PRIOR ART
FIG. 1 is a perspective view of a prior-art lighting track illustration from an applicant's U.S. Pat. No. 4,822,292 for a tracklight system.

In FIG. 1 a perspective view of a lighting tracklight system from applicant Jack V. Miller's prior-art U.S. Pat. No. 4,822,292, shown in a typical room setting. A prior-art track 2, mounted to a ceiling 4, has depending tracklight fixtures 3 shown as typical plain cylinders.

Figure 2:
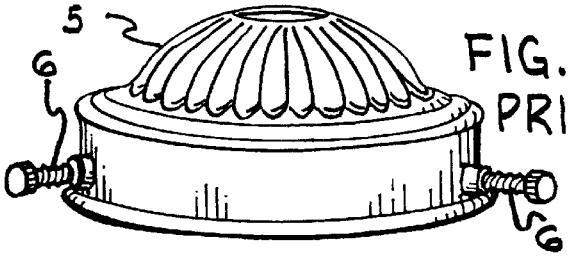
FIG. 2 PRIOR ART
FIG. 2 is a perspective view of a popular prior-art glass shade holder that uses thumb screws to attach a shade to a light fixture.
Figure 3:
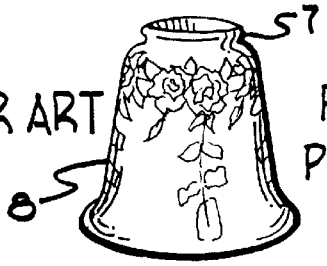
FIG. 3 PRIOR ART
FIGS. 3 through 6 are side elevation views of a first typical glass shades having fitters for retention by the thumb screws of a holder as illustrated in FIG. 2.
Figure 4:
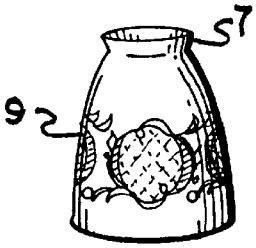
FIG. 4 PRIOR ART
Figure 5:
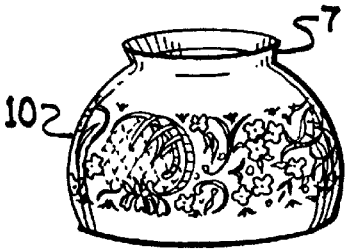
FIG. 5 PRIOR ART
Figure 6:
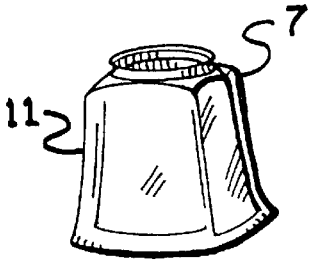
FIG. 6 PRIOR ART

More decorative downlight fixtures are also point-mounted on a canopy, a circular pan that supports a glass shade holder 5 as shown in FIG. 2. This is the most widely-used shade holder in residential lighting fixtures. The shade holder normally has three thumb screws that tighten on the fitter 7 of a glass shade, as shown in FIGS. 3 through 6. The fitter 7 has a an external circular groove to receive the ends of the thumb screws 6 of the shade holder 5.

Figure 7:
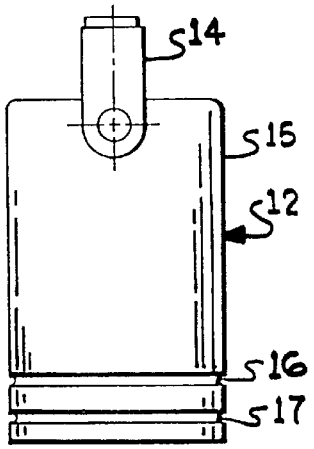
FIG. 7 is a side elevation view of a light fixture according to the present invention, adapted for installation of a decorative shade.

FIGS. 7 through 12 show a light fixture according to the present invention proceeding through the steps of installing a decorative shade. In FIG. 7 light fixture 12 has a cylindrical housing 15 pivotally supported at its proximal end from a fixture adapter 14. Fixture housing 15 is generally cylindrical, as is typical for small light fixtures. Housing 15 is provided with a first and second external ring grooves 16 and 17 at its distal end.

Figure 8:
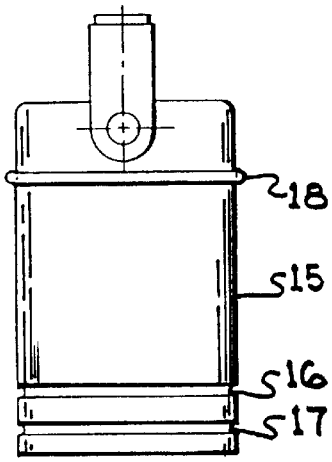
FIGS. 8 through 12 are illustrations of the steps for installing a decorative lens on a light fixture per FIG. 7.

In FIG. 8 the fixture of FIG. 7 is shown having a first resilient ring 18 positioned on cylindrical housing 15. There are many types of rings that will work in this application. Most satisfactory is a clear polycarbonate ring that is loosely fit onto the housing, but has three equally spaced internal bumps that fit tightly into the housing grooves. The polycarbonate is very heat resistant, and is optically clear to show the underlying colors of the fixture parts.

Figure 9:
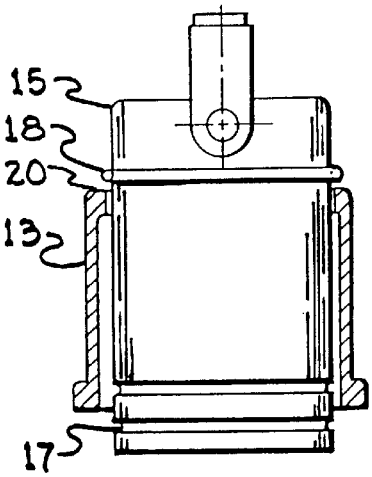
Figure 10:
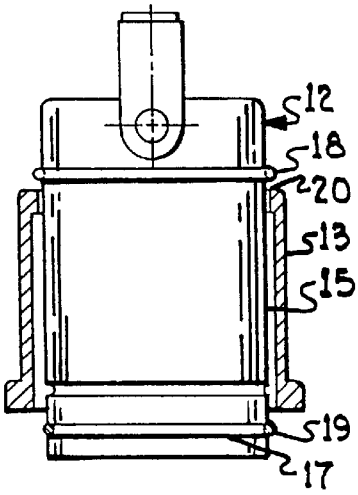
Figure 11:
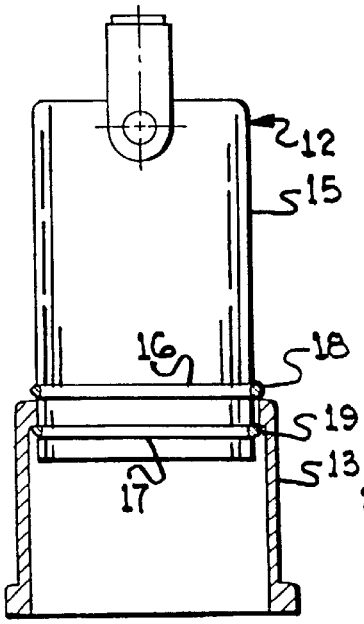
Figure 12:
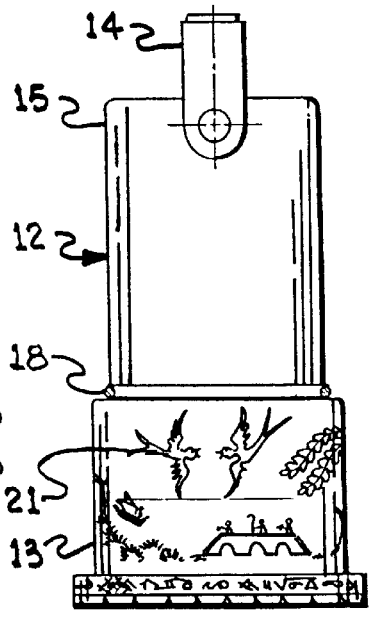

In FIG. 9 and FIG. 10 a decorative shade 13 is shown as loosely slidable on housing 15 up to ring 18. This exposes groove 17, into which second resilient ring 19 is installed. In FIG. 11 shade 13 is moved downwards into contact with second ring 19 and first ring 18 is slid downward into first groove 16. Thus the shade, having a decorative pattern 21 is easily and firmly locked in place with no stresses applied of the shade.

Figures 13, 14, 15:
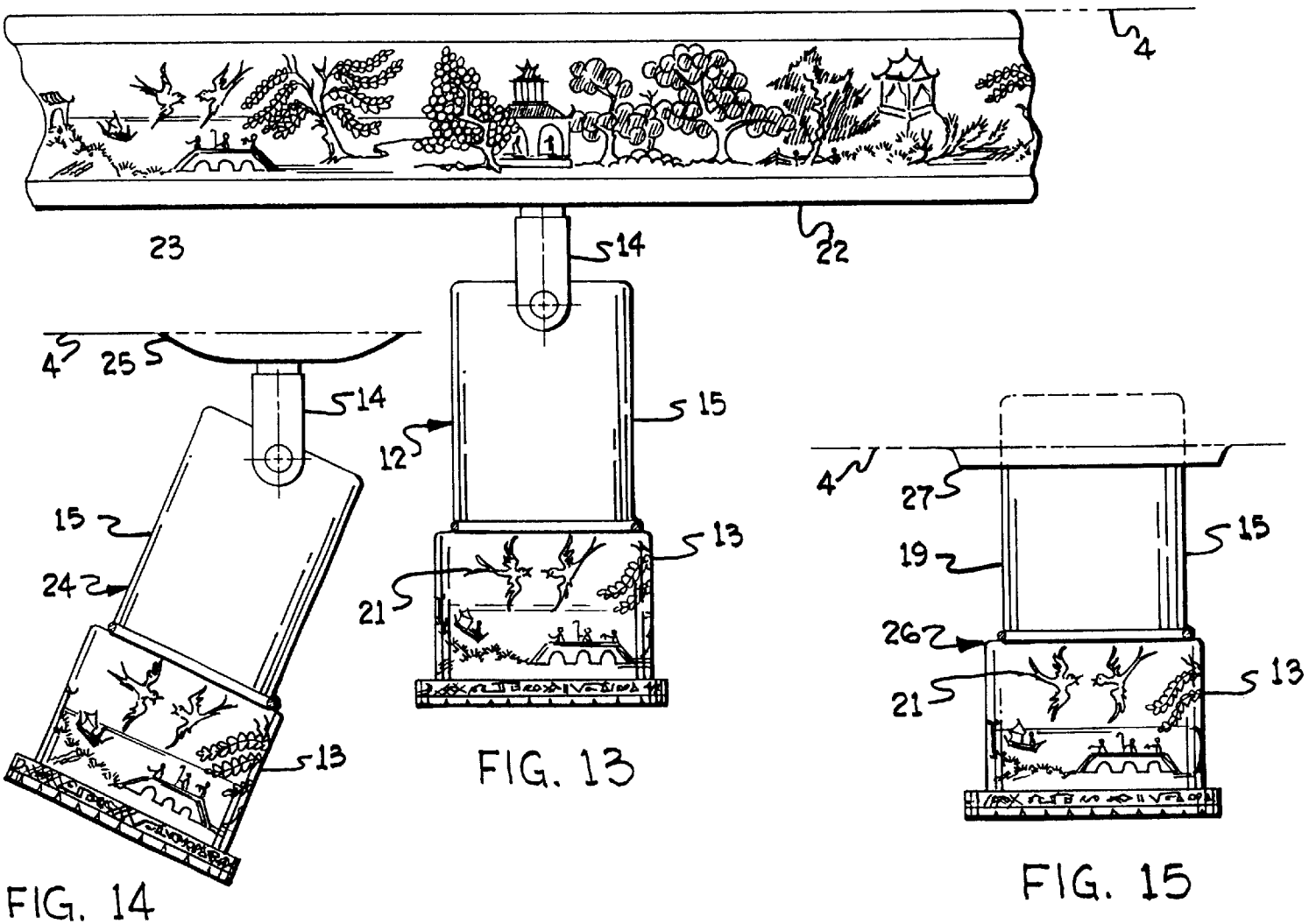
FIG. 13 is a side elevation view of a tracklight light fixture according to the invention and a track including the invention of the applicants' co-pending application entitled DECORATIVE LIGHTING TRACK.
FIG. 14 is a side elevation view of a fixture and shade according to the present invention, configured as a point-mounted aimable light attached to a canopy.
FIG. 15 is a side elevation view of a fixture and shade according to the present invention, configured as a fixed downlight partially recessed in a ceiling.

In FIG. 13 fixture 12 is shown mounted to a track 22 on ceiling 4. The track, having a matching decorative pattern 23, is the subject of the applicants' co-pending patent application referenced above. Decorative pattern 23 may be glazed on glass, embossed or pierced metal, or even wood applied to a heat-resistant substrate, such glass, ceramic or metal.

FIG. 14 shows a fixture and shade 24 according to the present invention, configured as a point-mounted aimable light attached to a canopy 25.

FIG. 15 shows a fixture and shade 26 according to the present invention, configured as a fixed downlight and supported by a ceiling mounting ring 27 with the fixture housing 15 partially recessed in a ceiling 4.

Summary, Ramifications and Scope

The present invention is a simple, reliable and inexpensive method for attaching decorative shades cylindrical fixtures, in which the housing has an external ring groove above and below a shade fitter. The shade fitter is axially held between a pair of resilient rings seated in the ring grooves. The fixture and shade have many applications that will be obvious to one skilled in the art. It is significant that in the 200 year history of light fixtures, this simple solution for assembling a shade to a fixture has remained undiscovered, as manufac-turers continue prior-art practices that have been used since the days of Edison.

What is claimed is:

1. A lighting fixture comprising:

a light fixture (12) having a proximal end fixture adapter (14) connectable to a mounting device (22, 25, 27), said fixture having a generally cylindrical housing (15) with a distal end;

first and second resilient rings (18, 19) partially engaged into first and second external grooves (16, 17) around the distal end of the housing;

a decorative shade (13) having a fitter (20) slidable on said housing and retained between the first and second resilient rings (18, 19).

2. A decorative lighting fixture (12) according to claim 1 in which the mounting device is a lighting track (22) including a fixture adapter (14) which is adjustable in azimuth and elevation.

3. A decorative lighting fixture (24) according to claim 1 in which the mounting device is a fixed canopy (25) attached to a ceiling (4) and a fixture adapter (14), adjustable in azimuth and elevation, is connected to the ceiling-mounted canopy (25).

4. A decorative lighting fixture according to claim 1 in which the mounting device is a ceiling ring (27) attached to a ceiling (4) and a portion of the fixture extends above the ceiling.

5. A decorative lighting fixture according to claim 1 in which the decorative shade (13) is made of materials selected from a group including plastic, metal and glass, with a pattern materials selected from the group including printing, painting, glazing, metal piercing and embossing, and wood embossing.

* * * * *